United States Patent [19]

Dixon, Sr. et al.

[11] 4,146,157

[45] Mar. 27, 1979

[54] ANTI-SPILL DRINKING CUP

[76] Inventors: Lester A. Dixon, Sr.; Lester A. Dixon, Jr., both of 5731 Castle Dr., Huntington Beach, Calif. 92649

[21] Appl. No.: 743,850

[22] Filed: Nov. 22, 1976

[51] Int. Cl.[2] ..... A47G 19/22

[52] U.S. Cl. ..... 222/424; 222/478; 222/568; 128/222; 220/90.4

[58] Field of Search ..... 220/90.4, 90.2, 90.6; 128/222; 222/109, 571, 478, 568, 424

[56] References Cited

U.S. PATENT DOCUMENTS

| | | | |
|---|---|---|---|
| 247,780 | 10/1881 | Randall | 128/222 A X |
| 727,228 | 5/1903 | Tonks et al. | 222/478 |
| 2,414,697 | 1/1947 | Petterson | 220/90.4 |
| 2,456,989 | 12/1948 | Polcyn | 222/478 X |
| 3,360,160 | 12/1967 | Spencer | 220/90.4 |
| 3,727,808 | 4/1973 | Fitzgerald | 220/90.4 X |

*Primary Examiner*—Robert J. Spar
*Assistant Examiner*—Frederick R. Handren
*Attorney, Agent, or Firm*—Edward E. Roberts

[57] ABSTRACT

A top (or lid) for an existing drinking cup which permits the insertion of a liquid into the cup without removal of the top and which also prevents the liquid from splashing or spilling from the cup during the filling or drinking operation. The top comprises means for fixing same to the cup or similar receptacle. The top includes suitable holes or apertures for permitting the passage of fluid therethough. Likewise, the top includes suitable openings or apertures for permitting the passage of air therethrough when the fluid is being inserted into the cup. A lip or rim describes the outer periphery of the top. In one embodiment, a mouth piece may be integrally formed with the lip. In another embodiment, the apertured member may be separate from the top.

5 Claims, 3 Drawing Figures

ANTI-SPILL DRINKING CUP

BACKGROUND

1. Field of the Invention

This invention is directed to drinking cups in general, and to an anti-spill top for cups, in particular.

2. Prior Art

There are many known drinking cups in the prior art. However, most of the prior art cups or lids have one or more shortcomings therein.

A preliminary search has uncovered as the best prior art known to applicant to be U.S. Pat. Nos. to Peterson (2,414,697); Kersh (2,550,568); Abelson (2,569,139); Rice (2,622,420); Bryant (2,765,639); Schwartz (3,172,561); Spencer (3,360,160); Fitzgerald (3,727,808); Dibrell (3,730,399); Paz (3,739,938); Dibrell (3,797,696); and Barnet (3,806,023).

None of the above patents are believed to show the invention described herein. In addition, each of these references is believed to have one or more shortcomings which is overcome by the instant invention.

SUMMARY OF THE INVENTION

The invention is directed to a top for a drinking cup or the like. The top has at least one aperture for receiving a liquid therethrough and at least one other aperture for permitting air to escape from the cup which is being filled. An appropriate lip surrounds the lid and forms the periphery thereof.

In one embodiment, a drinking mouth piece is provided adjacent to the lip. In another embodiment, the lid comprises a porous member which includes plurality of apertures such as those described above.

DESCRIPTION OF PREFERRED EMBODIMENT

Figure 1:
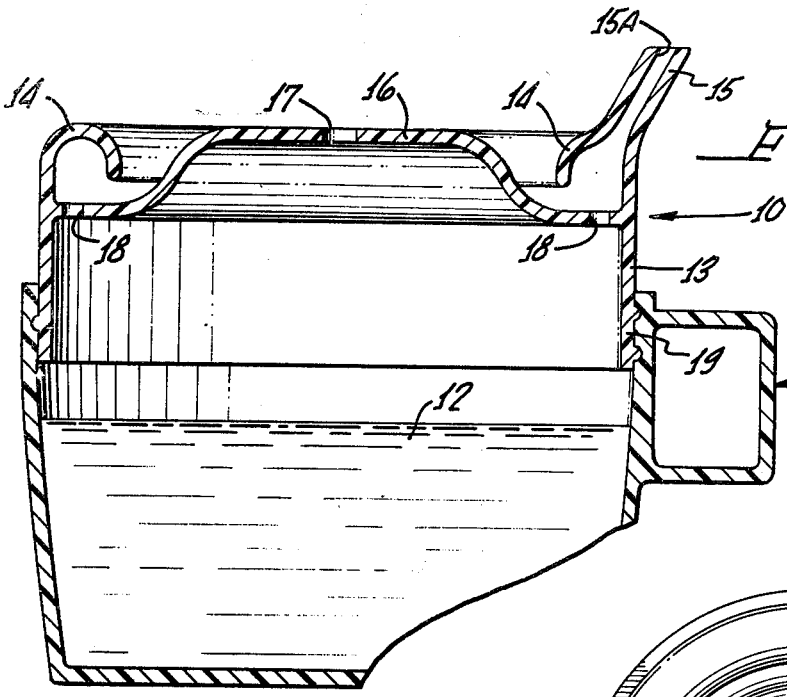
FIG. 1 is a cross section of the lid in the instant invention as disposed on a suitable cup or other receptacle.
Figure 2:
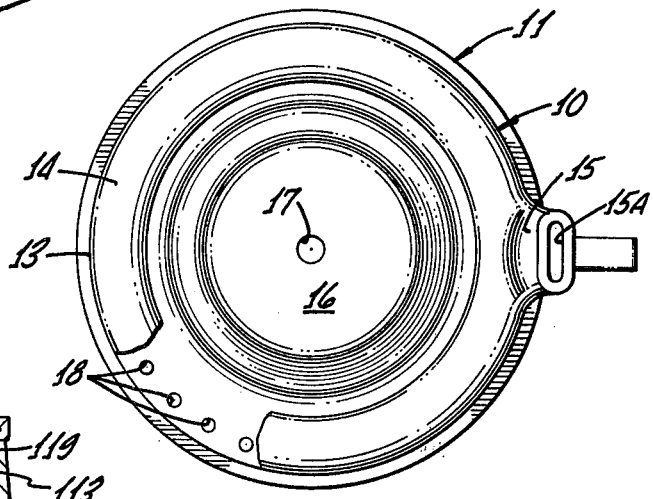
FIG. 2 is a top view of the lid shown in FIG. 1.

Concurrent reference is now made to FIGS. 1 & 2. In particular FIG. 1 is a cross sectional view of the invention while FIG. 2 is a top view thereof. The anti-splash lid which forms the instant invention is referred to generally by reference numeral 10. The lid 10 is adapted for utilization with a cup or similar receptacle 11 indicated by a dashed line. A liquid or similar material 12 is illustrated within cup 11. In a typical application of the instant invention, cup 11 is a cup of a standard thermos jug which has internal threads at the upper lip thereof. Consequently, cap 10 is shown having a threaded portion 19 which mates with the threads of the standard insulated cup. However, it must be understood that the threaded portion 19 can be eliminated and a suitable force-fit arrangement provided. Thus, the threads may be replaced by a single, annular ring or the like.

Top 10 includes side portions 13 which define the outer periphery of the top. Sidewalls 13 may be formed integrally or continuously with threaded portion 19. The upper end of sidewalls 13 is preferably curved inwardly to form a lip 14. The extent of the curve or lip 14 can be varied depending upon the specific design required. Thus, lip 14 need not be reversed upon itself as severely as shown in FIG. 1.

The upper lid portion 16 is a substantially continuous cap layer which extends across the circular area defined by sidewalls 13. Cap layer 16 is joined to side walls 13 below lip 14. In the embodiment shown, cap layer 16 is an inverted dish shape configuration. However, this specific configuration of cap layer 16 is not critical to the invention, per se. However, the central portion of cap layer 16 is preferably higher that the edges which are joined with sidewalls 13. In point of fact, cap layer 16 and sidewalls 13, as well as lip 14, can be molded or fabricated as an integral unit.

It is noted, that the configuration cap layer 16 is such that edges thereof are depressed relative to the center. The arrangement of cap layer 16 and sidewalls 13, in conjunction with lip 14, provides an annular trough-like arrangement at the edge of top 10. A plurality of apertures 18 are provided in this trough arrangement. Preferably apertures 18 are located at the lowest point of the trough such that fluid deposited in the trough will inherently travel towards apertures 18 and flow therethrough. While it is not essential, apertures 18 may include a champfered or counter sunk upper lip. In addition, an annular channel may be formed in the trough which channel cooperates with apertures 18 in order to direct fluid through these apertures.

Likewise, aperture 17 is provided at the center of cap layer 16. Aperture 17 may, in fact, provide a plurality of openings for a single opening. Aperture 17 is provided in order to permit air in cup 11 to escape when liquid is poured into the cup. Thus, liquid to be placed in the cup is merely poured on cap layer 16 after cap 10 has been placed on cup 11. Because of the configuration of cap layer 16, the fluid or liquid will tend to run toward the trough formed at the edge of layer 16. Furthermore, the fluid will tend to flow through apertures 18 into cup 12. As air is displaced by the fluid entering cup 12, the air is permitted to escape through aperture 17 to permit an equilibrium condition. Thus, cup 12 can be filled to the extent desirable with the anti-spill cap 10 in place. In addition, the trough formed between cap layer 16 and sidewalls 13 tends to prevent the liquid from splashing out of the cup while the cup is being filled. Moreover, lip 14 is arranged to permit the fluid to flow into the trough but to prevent the fluid from overflowing the edge of side wall 13.

Also affixed to the upper edge of sidewall 13 or to a portion of lip 14 as the case may be, is a suitable mouthpiece 15 with an aperture 15A therethrough. It is suggested that mouthpiece 15 may be formed integrally with sidewall 13 and lip 14 to facilitate drinking from cap 10. Drinking is effected through aperture 15A. Of course, mouthpiece 15 may be somewhat elongated wherein aperture 15A may be a elongated channel-like aperture or may be a plurality of apertures within mouthpiece 15.

In operation, mouthpiece 15 is used by the drinker by inserting the mouthpiece into the user's mouth. Cup 11 with cap 10 affixed thereto is then tilted in the standard fashion. Liquid 12 in cup 11 runs upwardly along the side of the cup and passes through apertures 18 in the reverse direction relative to the filling operation. The fluid then forms in the trough in the lower portion of the trough as the cup is tilted. Lip 14 prevents the fluid from over-flowing and spilling from the cup. Lip 14 tends to channel the fluid to the bottom portion of the cap as tilted. The fluid then either passes through aperture 15A in a normal manner or may be drawn therethrough somewhat in the fashion of a straw, if so desired. However, it is clear the drinking from cup 11 with cap 10 thereon prevents spilling of fluid from the cup or the cap wherein the cap is especially useful for both filling and drinking from a cup in a moving environment such as in a moving vehicle or the like.

Figure 3:
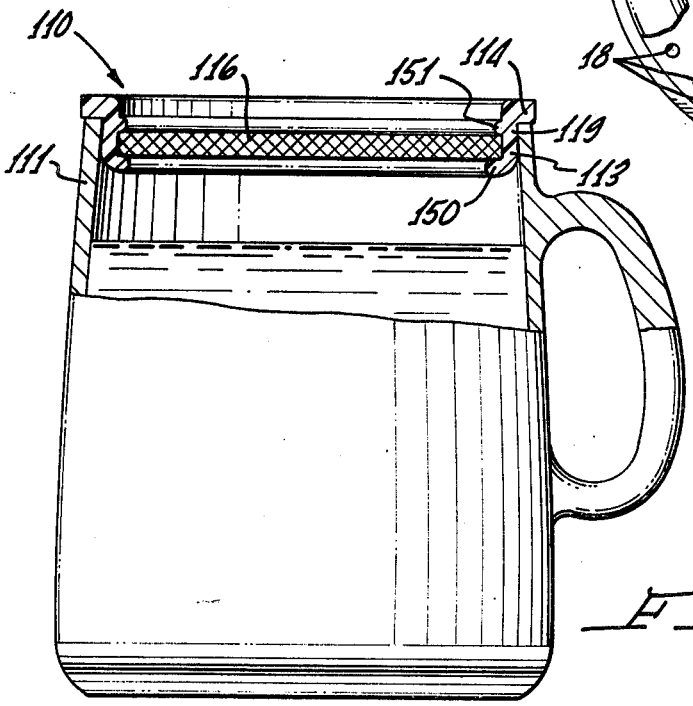
FIG. 3 is a cross sectional view of another embodiment of the instant invention.

Referring now to FIG. 3, there is shown another embodiment of the instant invention. In this embodiment, cap 110 is applied to cup 111. For convenience, a portion of cup 111 is broken away to show a cross sectional view of cap 110. Cap 110 includes sidewall 113 to define the cap perimeter. Sidewall 119 provides a force fit (or a threaded fit if desired) with cup 111. Lip 114 is provided to seat cap 110 in cup 111.

In the embodiment shown in FIG. 3, cap layer 116 may be a separable(or integrally mounted) portion of a porous material which has a relatively thick cross section. The configuration of cap layer 115 may be likened to a Brillo pad, steel wool or the like which is a relatively continuous but porous material. As noted, cap layer 116 may be integrally formed with cap 110 and joined to the inner surface of side walls 113. Conversely, side walls 113 may include a ledge or lip 150 on which a separable cap layer or splash guard 116 is seated.

With cap 110 inserted into cup 111 as suggested in FIG. 3, the fluid to be inserted into the cup is poured through cap layer 116 which is sufficiently porous as to permit ready flow of fluid therethrough under influence of gravity or the like. Likewise, when cup 111 is tilted to drink, a large body of fluid in cup 111 will impinge upon the underside of splash guard 116 and force its way therethrough. However, cap layer 116 is insufficiently pourous to permit random drops or splashing of fluid to pass therethrough. Consequently, a controlled reverse flow of fluid through cap layer 116 is provided.

In those instances where cap layer 116 is a separately removable member, it may be desirable to include a second lip 151 which extends around the inner periphery of side walls 113 to retain cap layer 116 in place. Of course, lip 151 may merely be a plurality of knobs or similar protrusions which will maintain layer 116 in its proper location.

Thus, there has been shown and described a cap or drinking cup which facilitates filling and splash free drinking from the cup. This cap permits drinking from a cup in environments involving motion such as trucks, cars, trains or the like. The embodiments of the invention shown and described are the preferred embodiment. Clearly those skilled in the art may percieve modifications to the embodiment herein. However, any modifications which fall within the purview of the description are intended to be included therein as well. The scope of the invention is not limited to the illustrations shown or the above descriptions. The scope of this invention is determined by the claims appended hereto.

Having thus described the preferred embodiment of the invention what is claimed is:

1. An anti-spill lid comprising:

a sidewall member having a generally circular configuration adapted to co-operate with a receptacle;

a cap layer arranged within said sidewall member and spanning the area enclosed by said sidewall member, said cap layer including at least one aperture substantially centrally located relative to said cap layer;

said cap layer and said sidewall member forming an annular trough adjacent said sidewall, said trough including a plurality of apertures therein wherein said apertures readily pass liquid therethrough in order to fill said receptacle, but generally impede the flow of liquid out of said receptacle in order to prevent spills, lip means for drinking from said receptacle joined to said sidewall member and overlying said trough, said lip means formed by the upper portion of said sidewall member being curved inwardly and overhanging said plurality of apertures in said trough; and said cap layer is higher than the edges thereof which are joined to said sidewall member; and spout means for pouring or drinking from said receptacle fromed in said lip means and projecting therefrom.

2. The lid recited in claim 1 including:

threaded portions of said sidewall member for engagement with said receptacle.

3. The lid recited in claim 1 wherein said cap layer is formed with an inverted dish shape configuration.

4. The lid recited in claim 1 wherein said plurality of apertures in said trough are located at substantially the lowest point of said trough.

5. The lid recited in claim 1 wherein said spout means is elongated from said lip means and includes at least one channel-like aperture therethrough.

* * * * *